United States Patent [19]

Hillstrom

[11] Patent Number: 4,823,533

[45] Date of Patent: Apr. 25, 1989

[54] STRUCTURAL CLADDING APPARATUS

[75] Inventor: David U. Hillstrom, Novi, Mich.

[73] Assignee: Marketing Displays, Inc., Farmington Hills, Mich.

[21] Appl. No.: 139,479

[22] Filed: Dec. 30, 1987

[51] Int. Cl.[4] ..... G09F 13/04

[52] U.S. Cl. ..... 52/727; 52/510; 40/607

[58] Field of Search ..... 52/727, 728, 235 R, 52/392, 510; 40/607

[56] References Cited

U.S. PATENT DOCUMENTS

| | | | |
|---|---|---|---|
| 1,918,570 | 7/1933 | Sheras | 40/607 |
| 2,316,539 | 4/1943 | Patterson | 40/607 |
| 2,899,764 | 8/1959 | Oberlin | 40/607 |
| 2,954,627 | 10/1960 | Kies | 40/607 |
| 3,413,775 | 12/1968 | Katz | 52/727 |
| 3,893,251 | 7/1975 | Coleman | 40/607 |
| 3,998,028 | 12/1976 | Pelletier | 52/727 |
| 4,606,167 | 8/1986 | Thorne | 52/727 |
| 4,650,702 | 3/1987 | Whitmyer | 52/235 |

*Primary Examiner*—Henry E. Raduazo
*Attorney, Agent, or Firm*—Harness, Dickey & Pierce

[57] ABSTRACT

A cladding apparatus is adapted for substantially enclosing or covering at least a portion of a building component and includes at least a pair of spaced-apart elongated frame members extending generally along the structure. A number of cross members extend laterally between, and form an interconnection for, adjacent pairs of the corner frame members and are longitudinally spaced apart from one another. At least one cladding panel member is snapped onto the frame members to cover and laterally interconnect the frame members, extending longitudinally therealong in a spaced relationship with the building structure. The finished installation is accomplished with few or no visible fasteners and results in a neat and attractive appearance for new construction or for renovation work. The apparatus also preferably includes features for disposing the cladding system in various preselected offset relationships with the structure.

20 Claims, 7 Drawing Sheets

STRUCTURAL CLADDING APPARATUS

BACKGROUND AND SUMMARY OF THE INVENTION

The invention relates generally to structural cladding apparatuses, and more particularly to such cladding apparatuses adapted for substantially enclosing or covering all, or at least a portion of, a column, pole, wall, or other such building structure, either in new construction or in renovation of existing construction.

In construction of commercial, and even residential, building structures, it is frequently found to be necessary or desirable to substantially enclose or cover all or a portion of structural building components in order to provide a neat, attractive, or up-scaled appearance. Such need or desirability occurs both in construction of new building structures and in renovation or remodeling of existing building structures. In the past, however, the components and materials required for enclosing or covering all or a portion of a building structure have not had sufficient structural strength, have been relatively expensive to manufacture, transport, and install, and have frequently lacked a neat and attractive appearance, largely due to an inordinate amount of visible, unattractive seams and to the necessity for the use of fasteners or other mounting devices that are visible in the finished installation. In addition, such conventional components or materials for such cladding and covering applications have sometimes necessitated the use of relatively expensive, highly skilled personnel for installation, and have often been unable to conveniently accommodate electrical wiring and components or signs and other displays.

In renovation or remodeling of existing building structures, the problems and disadvantages mentioned above in connection with the use of conventional cladding and covering materials and components are especially difficult to overcome. For example, the correction of existing misalignments or improper placement of existing structural components is difficult to achieve, and any desired changes in the positioning, orientation, or size of existing structural members in order to effect an upgraded appearance can present obstacles that are insurmountable or at least very difficult to overcome.

Accordingly, the present invention seeks to overcome the problems and obstacles discussed above by providing a cladding or covering apparatus adapted for substantially enclosing or covering, all or a portion of new or existing structural building members and that is relatively inexpensive to manufacture, transport and install, while still providing a neat, attractive and upscaled appearance. The cladding apparatus according to the present invention results in a minimum amount of visible seams, with no visible fasteners, while still providing a structurally sound installation. In addition, the cladding apparatus according to the present invention is easy to assemble and install by ordinary workers, using ordinary tools. The cladding apparatus according to the present invention also provides a maximum amount of adaptability when changes or corrections in existing sizes, locations, or configurations of structural building members are desired.

In accordance with the present invention, a cladding apparatus is adapted for substantially enclosing or covering at least a portion of a structure and includes at least a pair of spaced-apart elongated frame members extending generally along the structure. A number of cross members are spaced away from the structure and extend laterally between, and form an interconnection for, adjacent pairs of the corner frame members and are longitudinally spaced apart from one another. At least one cladding panel member laterally interconnects the frame members and extends longitudinally therealong in a spaced relationship with the building structure. Thus, when the frame members are mounted on, or interconnected with, the building structure, the cross members provide support for the cladding panels.

In many applications of the present invention, a number of pairs of mounting members are disposed at a generally aligned longitudinal position relative to the cross members. Each pair of the mounting members is secured to generally opposite lateral sides of the building structure, such as a column or pole for example, with each pair of mounting members laterally interconnecting a pair of the cross members, which are in turn spaced from second generally opposite sides of the column, pole, or other longitudinally-extending building structure. Preferably, the frame members have flange portions extending along their lateral sides, and the cladding panel members have angled edge portions adapted to engage the flange portions in order to secure the cladding panel to the frame members, while still allowing selective removal of the panel. Such engagement of the angled edge portions is either accomplished wholly without the need for fasteners or configured such that the angled edge portions of adjacent cladding panel members substantially obscure the fasteners from view.

In addition to the above, the cladding apparatus according to the present invention preferably includes a provision for preselectively altering the lateral positioning or angular orientation of the cladding apparatus relative to the column, pole, or other such building structure. In other applications, wherein the cladding apparatus is used to cover all or a portion of a wall, with a portion of the cladding apparatus protruding outwardly from the edge of the wall or bridging a space between adjacent spaced-apart walls, a cladding panel or other such backing panel is provided for covering the internal structural components of the cladding apparatus from view on the opposite side of the outwardly-projecting portion of the cladding structure.

Additional objects, advantages and features of the present invention will become apparent from the following description and appended claim, taken in conjunction with the accompanying drawings.

BRIEF DESCRIPTION OF THE DRAWINGS

FIG. 4 is an exemplary cross-sectional view taken generally along line 4—4 of FIG. 2.

DETAILED DESCRIPTION OF THE PREFERRED EMBODIMENTS

Figure 1:
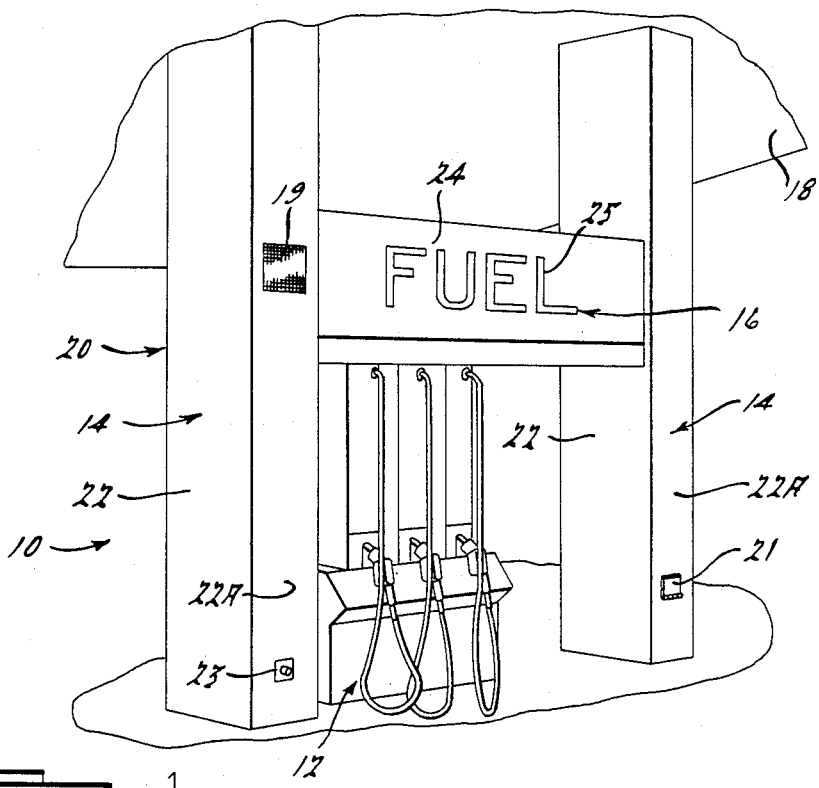
FIG. 1 is an overall prospective view of an exemplary application of the cladding apparatus according to the present invention, wherein columns of opposite sides of fuel pumps at a service station are substantially enclosed by the cladding apparatus, with cladding also substantially enclosing or covering a horizontal spandrel member laterally interconnecting the columns or poles.

FIGS. 1 through 18 illustrate various exemplary embodiments of a cladding apparatus or system according to the present invention wherein the cladding apparatus is employed for substantially enclosing or covering all or a portion of a building structure or building structural component. One skilled in the art will readily recognize from the following discussion, taken in conjunction with the accompanying drawings and claims, that the principles of the present invention are equally applicable to installations other than those shown for illustrative purposes in the drawings.

In FIG. 1, a service station 10 includes one or more fuel pumps 12 flanked on opposite sides by column assemblies 14, which are horizontally interconnected by a spandrel assembly 16, and covered by a roof or canopy 18. A cladding system 20 according to the present invention includes cladding panels 22, 22A and 24 for substantially enclosing, or at least covering, the vertical columns 15 (shown in FIG. 3) and forming the horizontal spandrel assembly 16, respectively. The cladding panels shown throughout the drawings, in the various exemplary embodiments of the invention can be made of aluminum or other suitable lightweight and durable materials, which can be opaque, translucent, or transparent. The cladding panels can also be painted, coated or otherwise finished in a variety of known finishes in order to provide a neat, clean, and up-scaled appearance.

In addition, as will become apparent from the following discussion, any of the cladding panels according to the present invention can optionally bear advertising or other desired messages. Such cladding panels can be used to house or enclose electrical wiring or lighting, audio speakers, video displays, fluid piping, or virtually any other accessories or equipment that are desired to be shielded from view or from the elements, but which requires access. Examples of these uses are shown in FIG. 1, wherein the cladding panel 24 is shown as a translucent panel bearing opaque lettering 25 in order to display a message by way of internal lighting (not shown). Alternately, this optional arrangement can be reversed, with the cladding panel 24 being opaque and the lettering 25 being translucent. The cladding panels 22A in FIG. 1 are also shown (for purposes of illustration only) as having an outdoor electrical outlet 21 thereon, as well as an air hose coupling 23 adapted for convenient connection to an air hose for servicing automotive tires or other inflatable objects and an audio speaker 19. These and other examples of similar features, accessories or equipment can also optionally be included in any of the embodiments of the invention.

Figure 2:
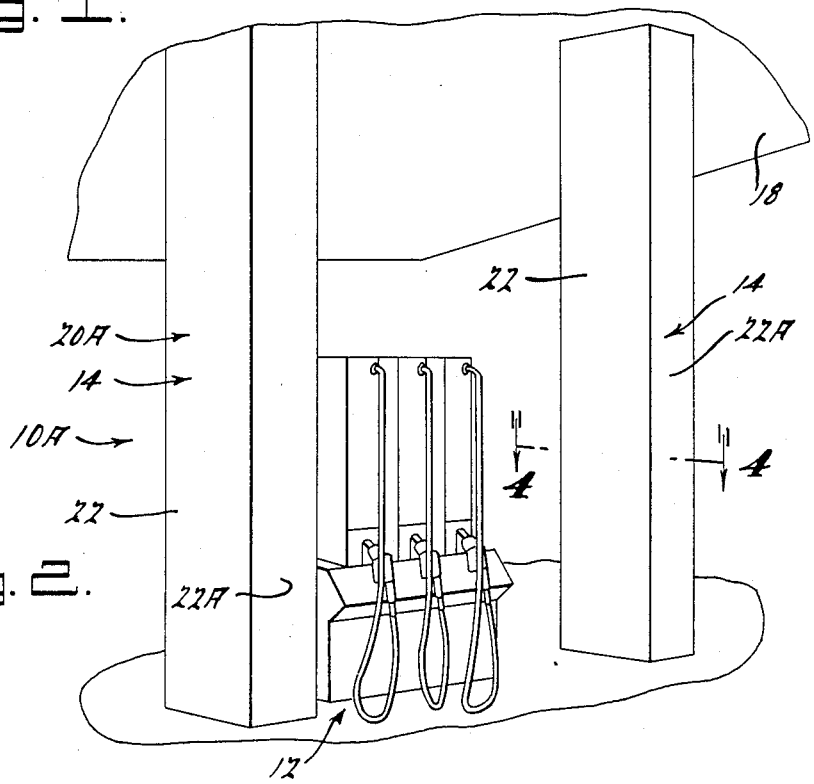
FIG. 2 is an overall perspective view similar to that of Figure 1, but illustrating the cladding apparatus according to the present invention in an application where no horizontal spandrel member is present.

In FIG. 2, a service station 10A is illustrated for exemplary and illustrative purposes, and is similar to the service station 20 in FIG. 1, except for the deletion of the spandrel assembly 16 and its covering cladding panels 24.

Figure 3:
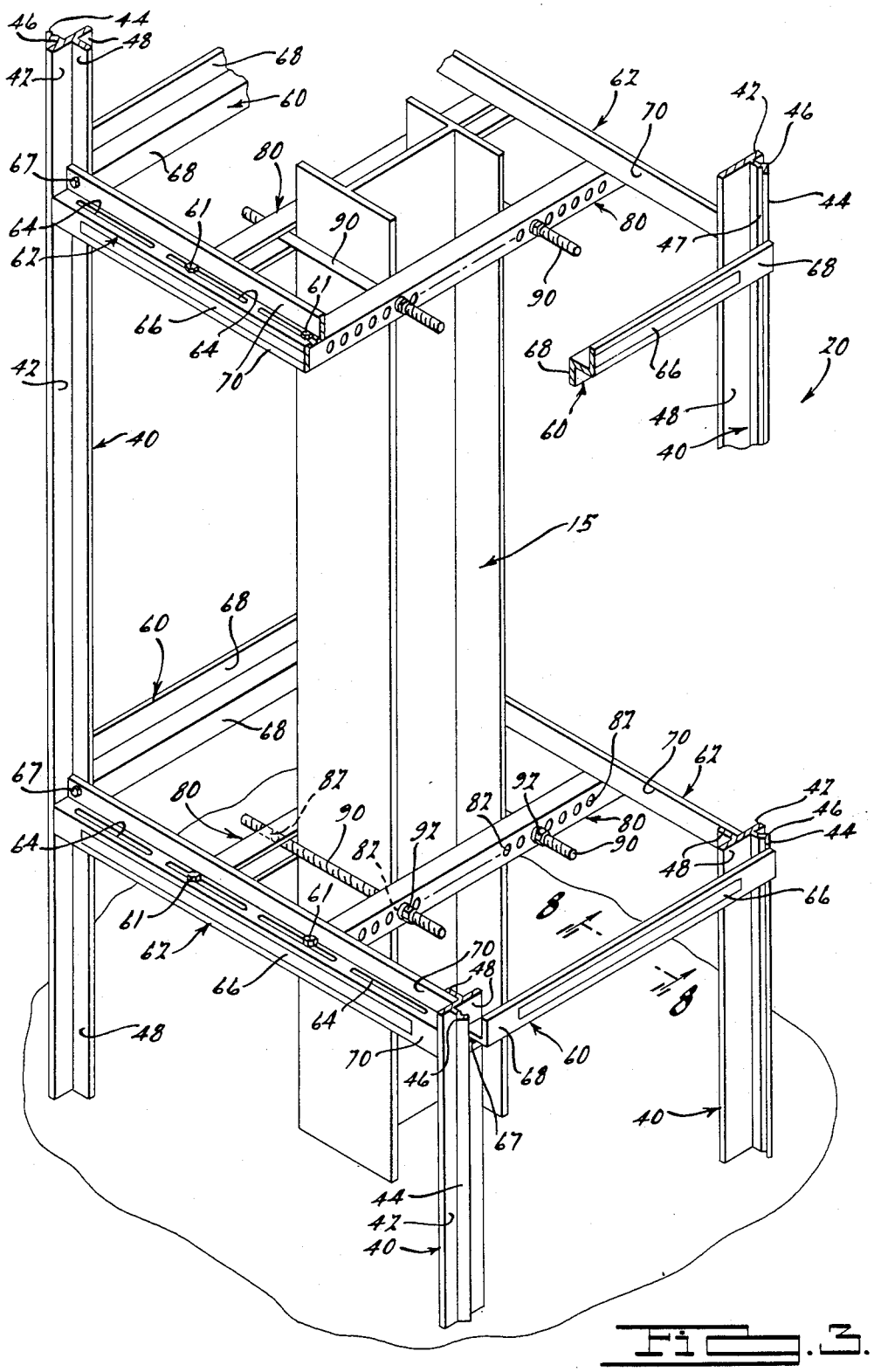
FIG. 3 is a partial perspective view, with portions cut away for clarity, of the internal supporting structural components of the cladding apparatus of FIGS. 1 and 2.
Figure 1:
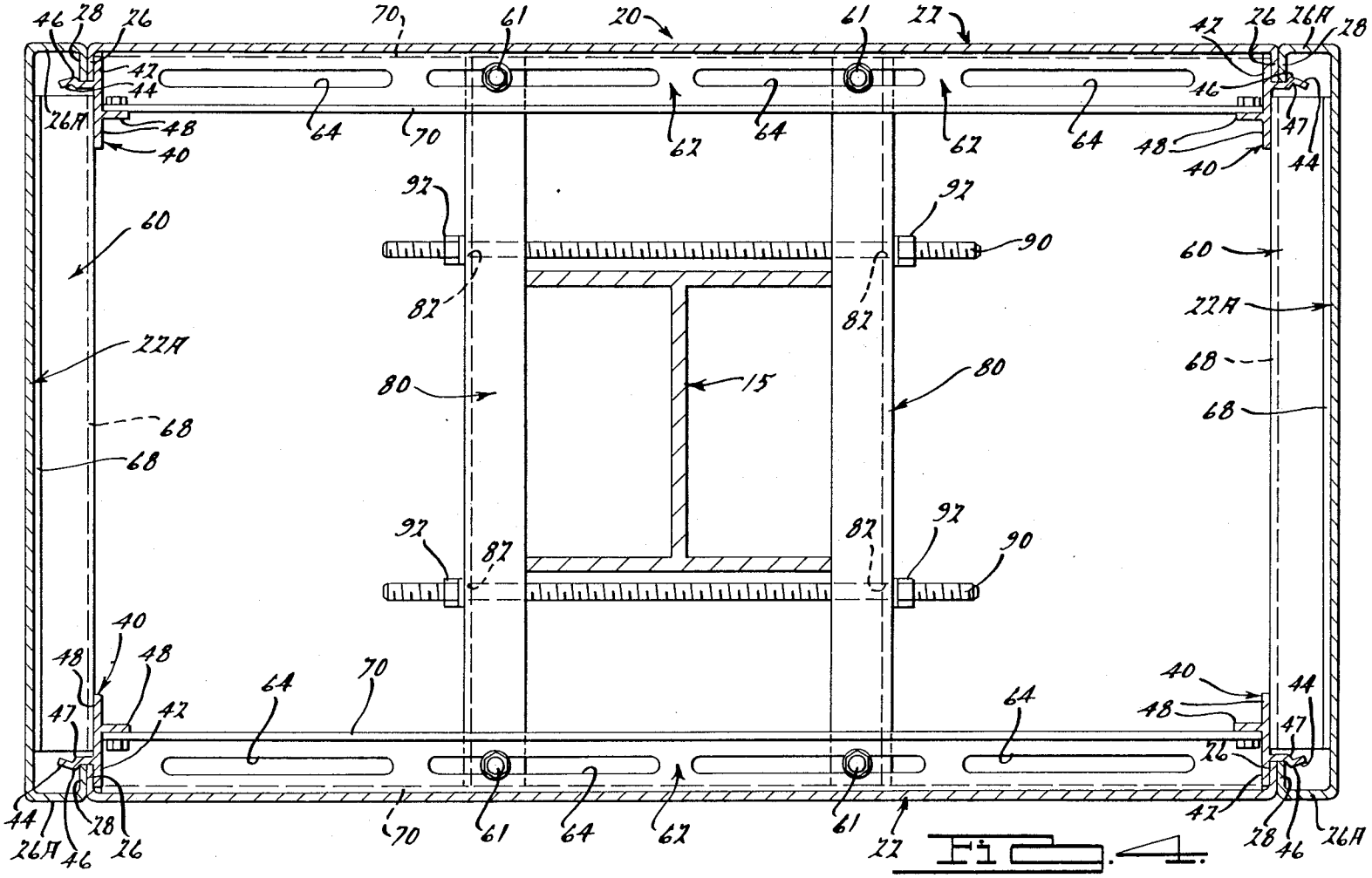

FIG. 3 illustrates an exemplary configuration for the underlying structural and attachment components for the cladding panels 22 and 22A of the cladding systems illustrated in FIGS. 1 and 2. A pair of corner frame members 40 are disposed on each pair of generally opposite sides of a structural column 15 and extend generally vertically or longitudinally along the column 15 in a generally parallel spaced relationship therewith. At longitudinally or vertically spaced intervals, pairs of cross members 60 are attached to, and interconnect, adjacent corner frame members 40 on first generally opposite sides of the column 15, and similar pairs of longitudinally or vertically spaced-apart cross members 62 are attached to, and interconnect, the corner frame members 40 on second generally opposite sides of the column member 15. Such attachment can be made in any of a number of well-known ways, such as by nuts and bolts, or the self-tapping fasteners 67 shown, for purposes of example, in FIGS. 3 and 4, which engage both the corner frame members 40 and the flanges 68 and 70 of the preferably "Z-shaped" cross members 60 and 62, respectively.

A corresponding number of preferably U-shaped mounting members 80 are disposed at longitudinal or vertical positions generally aligned with corresponding pairs of the cross members 62, with the mounting members 80 being attached to, and interconnecting, the cross members 62 on the above-mentioned second generally opposite sides of the column 15. Such attachment is preferably accomplished by way of a number of fasteners 61 extending through adjustment slots 64 in the cross members 62 and interconnected with the mounting members 80.

In order to secure the structure to the column 15, a pair of clamping members 90 are preferably provided for interconnecting each pair of mounting members 80, with the clamping members 90 forcibly urging the mounting members 80 laterally inwardly against the column 15. In one preferred embodiment of the present invention, the clamping members 90 are threaded rods extending laterally between the mounting members 80 and through mounting holes 82 therein. The threaded clamping members 90 are secured to the mounting members 80 in order to clampingly urge the mounting members 80 against the column 15 by way of engagement with threaded nuts 92. Preferably, a plurality of the mounting holes 82 are provided at laterally spaced intervals along the mounting members 80 in order to facilitate the preselective adjustment installation of the cladding system or apparatus 20 in a wide variety of applications, or to accommodate positioning of the cladding apparatus 20 and the cladding panels 22 in an angled or laterally offset relationship with the column 15, as is explained in more detail below. This feature, coupled with the laterally preselective adjustability provided by the above-mentioned slots 64 in the cross members 62 for the lateral positioning of the cross members 62 and thus the corner frame members 40 relative to the mounting members 80, provides a wide variety of preselective adaptability of the present invention in many diverse cladding applications.

Figure 5:
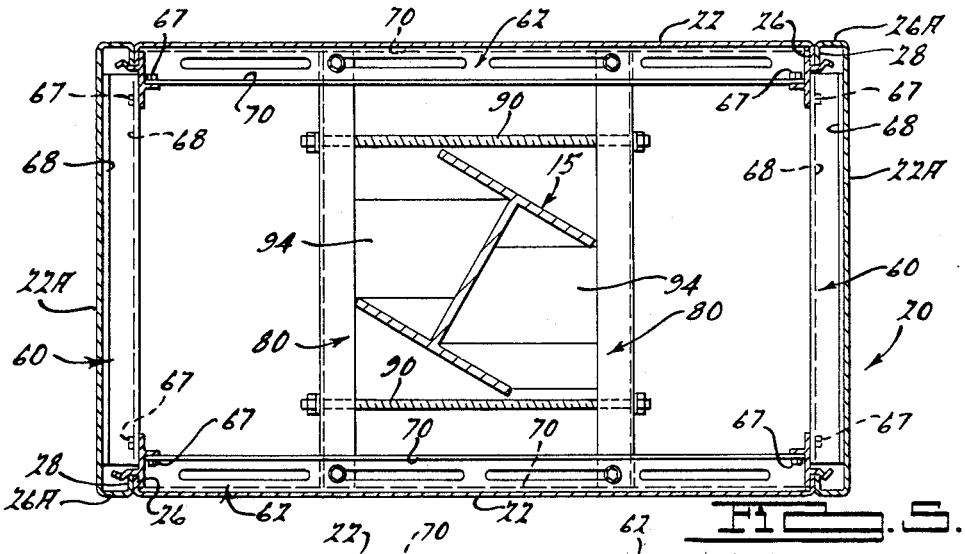
FIGS. 5, 6, and 7 are cross-sectional views similar to that of FIG. 4, but illustrating the adaptability of the cladding apparatus according to the present invention in installations where the positioning or orientation of the cladding apparatus is offset from that of the enclosed column, pole, or other structural member.
Figure 6:
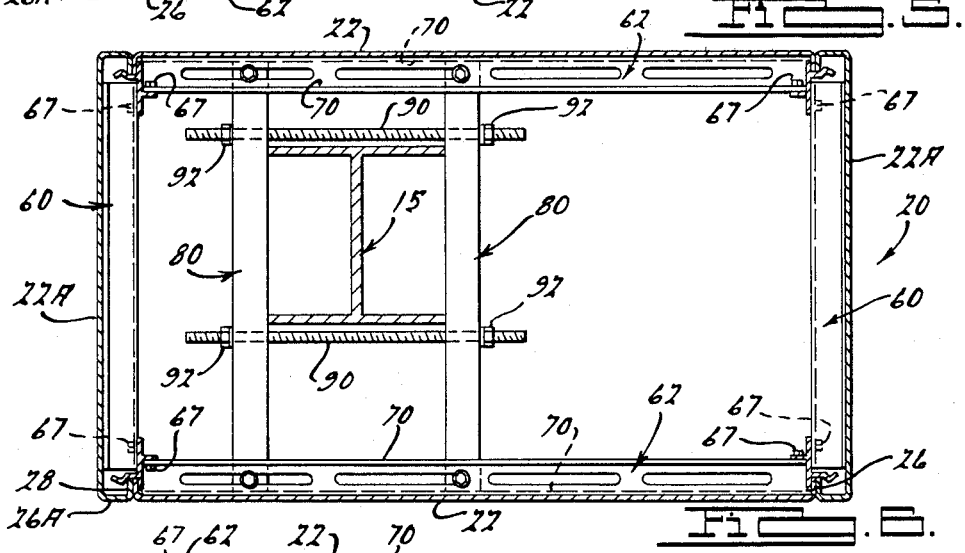
Figure 7:
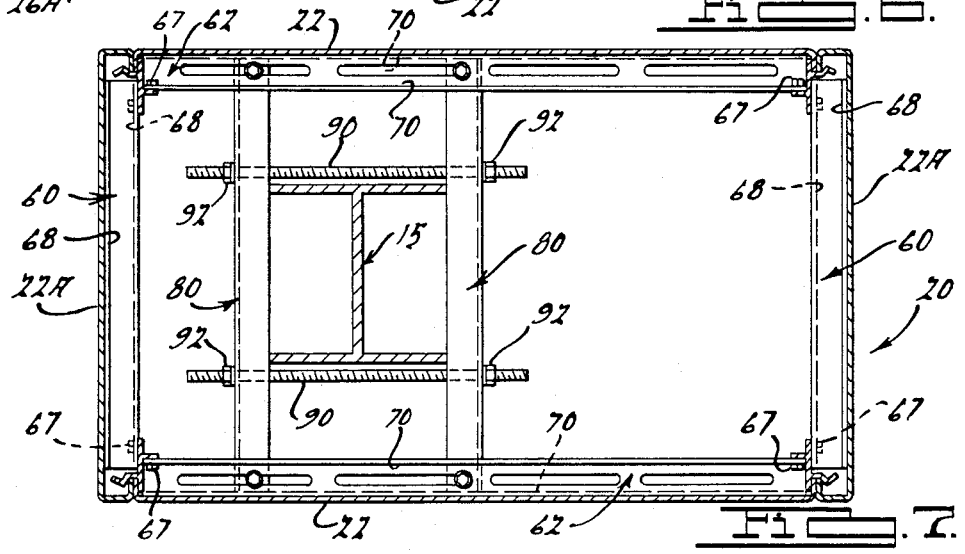
Figure 8:
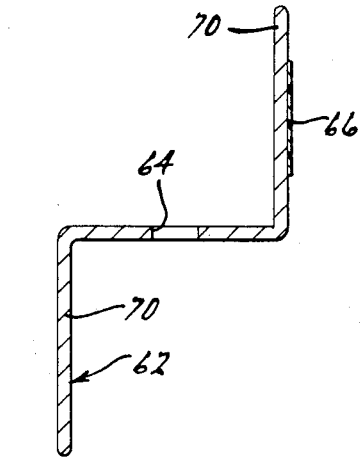
FIG. 8 is a cross-sectional view of one of the cross members of the present invention, taken generally along line 8—8 of FIG. 3.

Examples of such adaptability are illustrated in FIGS. 5 through 7, wherein the cladding apparatus 20 (or 20A) is offset relative to the column 15 in the exemplary applications shown in the drawings. In FIG. 5, angled spacer blocks 94, which can be composed of wood or other materials having suitable strength, are inserted between the column 15 and the mounting members 80 in order to offset the cladding apparatus at an angled disposition relative to the column 15. Similarly, in FIGS. 6 and 7, the cladding apparatus 20 (or 20A) is laterally offset relative to the column 15. Such angular or lateral offset relationships may be deemed necessary or desirable wherever changes are sought in the layout or appearance in a particular installation, for example.

Figure 9:
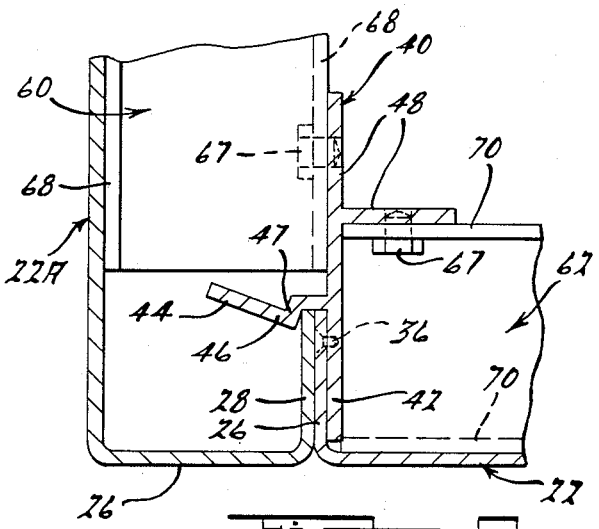
FIG. 9 is an enlarged, detailed cross-sectional view of a preferred corner configuration for the cladding apparatuses of FIGS. 1 through 7.
Figure 10:
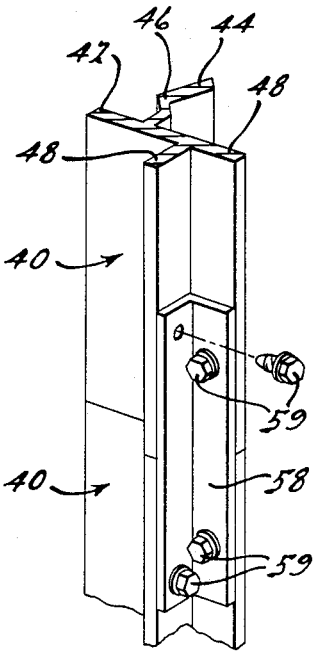
FIG. 10 is a partial detailed view of a mechanism by which frame members of the cladding apparatus according to the present invention can be spliced together.

As is perhaps best shown in FIGS. 3, 4 and 9, each of the corner frame members 40 preferably includes a generally flat flange portion 42 extending along its lateral side and protruding in a laterally outward direction therefrom. In addition, each of the preferred corner frame members 40 also includes a second generally non-flat flange portion 44 extending along the lateral side of the corner frame member 40 and protruding laterally therefrom at an angle with the flat flange portion 42. The non-flat flange portions 44 include angled discontinuities 46 thereon for engaging and securing the cladding panels 42A in a manner described in more detail below. In addition, for purposes of assuring proper alignment of the cladding panels 22 and 22A, each corner frame member 40 preferably includes a pair of stop flanges 48 adapted for abuttingly engaging the cross members 60 and 62, with the above-mentioned attachment of the cross members 60 and 62 being accomplished by securing the cross members 60 and 62 to the stop flanges 48 on the corner frame members 40, as is clearly shown in FIG. 9.

The cladding panels 22 and 22A preferably include angled edge portions 26 extending longitudinally therealong. In the preferred arrangement, the angled edge portions 26 are resiliently deflectable in order to resiliently and biasingly engage the corner frame members 40. On the cladding panel members 22, the angled edge portions 26 clampingly engage the generally flat flange portions 42 on the corner frame members 40 and can optionally, if needed or desired, be secured thereto by conventional attachment means, such as the self-tapping fasteners 36 shown, for purposes of example, in FIG. 9. The cladding panel members 22A, however, also include angled edge portion flanges 28 extending along the angled edge portions 26 of the cladding panel members 22A and protruding in a lateral direction therefrom.

By way of the resilient deflectability of the angled edge portions 26 and the angled edge portion flanges 28 on the cladding panel members 22A, the angled edge portion flanges 28 can be resiliently snapped onto the generally non-flat flange portions 44, over the angled discontinuities 46 thereon. This arrangement provides for a secure attachment of the cladding panel members 22A to the corner frame members 40, with the angled edge portion flanges 28 also serving to obscure the fasteners 36 (if any) from view. This also contributes to the securement of the cladding panel members 22 to the corner frame members 40 by way of the angled edge portion flanges 28 and the angled edge portions 26 of the cladding panel members 22 being resiliently trapped between the flat flange portions 42 and the angled discontinuities 46 of the corner frame members 40.

It should be noted, as is perhaps best shown in FIG. 9, that the angled discontinuities 46 each include a ramp portion 47 that is in a non-parallel relationship with the flat flange portion 42 on each corner frame member 40. The ramp portion 47 extends in a laterally outwardly diverging direction relative to the flat flange portion 42. This arrangement allows for ease of selective "snap-off" removal of the cladding panel 22A, thus allowing access to the interior of the structure. Merely by prying the cladding panel 22A toward the left (as shown in FIG. 9), the outward diverging configuration of the ramp portion 47 tends to aid in resiliently deflecting the angled edge portion 28 and thus allowing for convenient panel removal without permanent deformation and destruction of the angled edge portion 28. In early prototype testing of the cladding system, wherein the ramped portion 47 was parallel to the flat flange portion 42, such convenient selective panel removal was found to be virtually impossible without such permanent deformation and destruction.

In one preferred arrangement of the present invention, the cladding panel members 22 and 22A are further secured to the cross members 60 and 62 by way of an adhesive strip 66 (or a bead of adhesive material) disposed on the flanges 68 and 70 of the cross members 60 and 62, respectively. Such adhesive strip 66 also tends to prevent any undesirable outward bowing of the cladding of the panel members 22 and 22A relative to the cross members 60 and 62.

The cladding apparatus 20 (or 20A) also provides for a wide adaptability of applications using standard components. In one example of such adaptability, shown for purposes of illustration in FIG. 10, the corner frame members 40 can be manufactured in standard component lengths and longitudinally or vertically spliced together by way of an angled splice member 58 secured to the stop flanges 48 of end-to-end corner frame members 40 by way of suitable fastening means, such as the self-taping fasteners 59 show, for purposes of example, in FIG. 10. As one skilled in the art will now readily appreciate, similar splicing members can be used for splicing together standard component lengths of various other components of the cladding apparatus 20 (or 20A) in accordance with the present invention.

Figure 11:
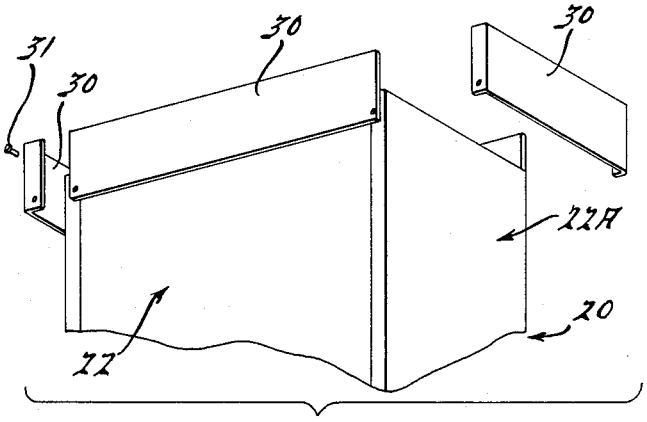
FIG. 11 is a partial exploded perspective view of a top or end trim arrangement for a cladding apparatus according to the present invention.
Figure 12:
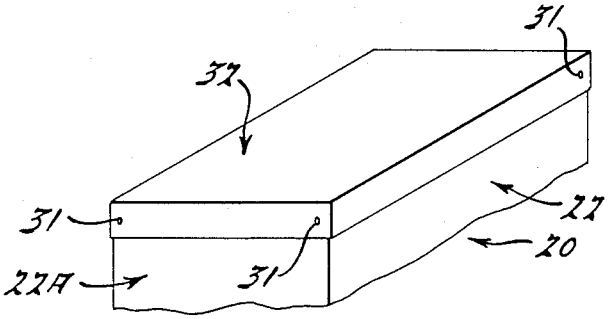
FIG. 12 is a view similar to FIG. 11, but illustrating an alternate top or end trim cap member for the cladding apparatus according to the present invention.
Figure 13:
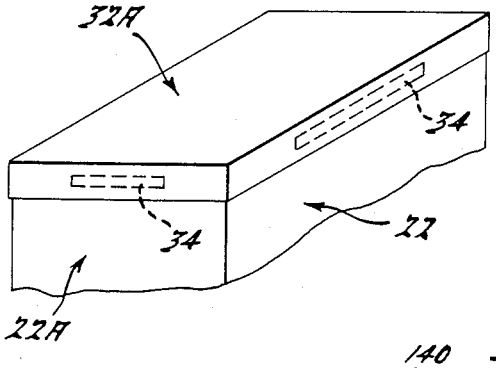
FIG. 13 is a view similar to that of FIGS. 11 and 12, but illustrating still another top or end trim cap member.

FIGS. 11 through 13 illustrate various alternate arrangements for finishing or trimming off an end or top of the assembled cladding apparatus 20 (or 20A). In FIG. 11, a number of top or end trim panels 30 are secured to the cladding panels 22 and 22A by any suitable means, such as by way of self-tapping threaded sheet metal screws 31 shown in, for example, FIG. 11. Typically, because of the distance of the trim panels 30 from the ground, and through use of suitably small fasteners, such fasteners are not readily visible to an observer and thus do not tend to distract in any appreciable way from the appearance of the finished cladding apparatus.

Alternately, as shown in FIG. 12, a top or end trim cap 32 can be placed over a top or end portion of the cladding apparatus 20 or 20A as a one piece member in substitution for the multiple piece trim panels 30 shown in FIG. 11. If, however, such fasteners 31 are not desired or are otherwise objectionable, an alternate top or end trim panel 32A, shown in FIG. 13, can be secured to the cladding panel members 22 and 22A by means of an adhesive strip 34 (or a bead of adhesive material).

Figure 14:
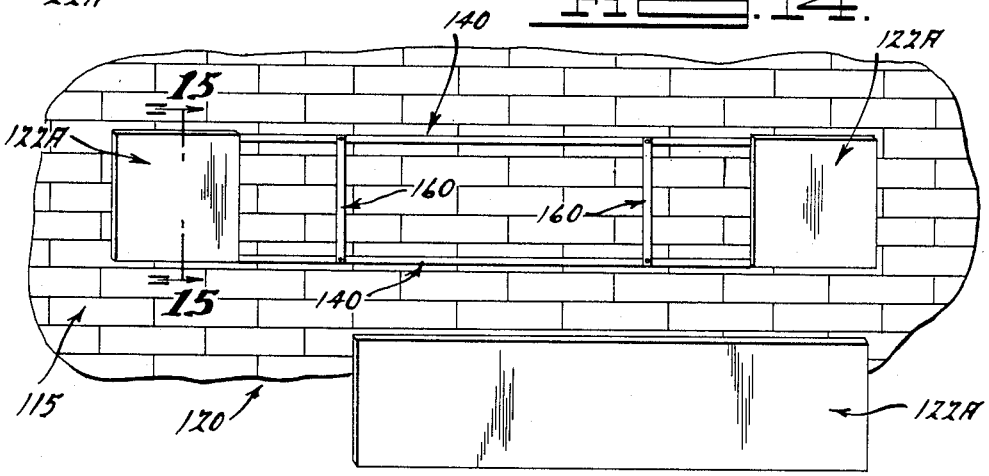
FIG. 14 is a partial exploded elevational view of another of the preferred embodiments of the present invention, wherein the cladding apparatus is used to cover a portion of the wall of the building for display or decorative purposes.
Figure 15:
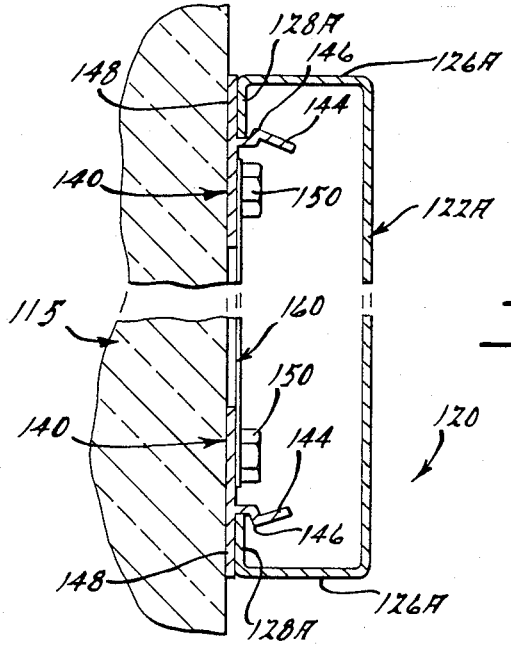
FIG. 15 is a cross-sectional view taken generally along line 15—15 of FIG. 14.
Figure 16:
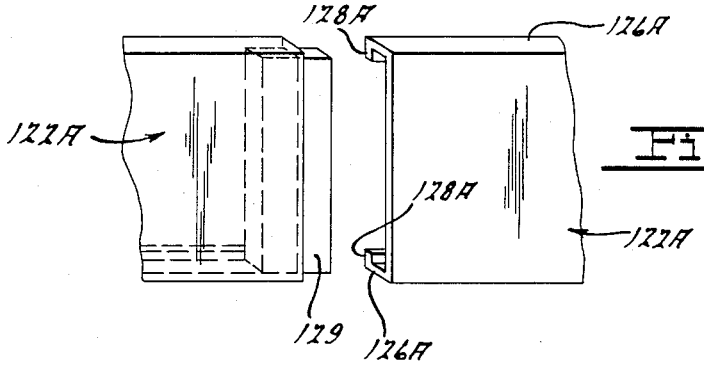
FIG. 16 is a detailed exploded view of a mechanism for interconnecting and supporting longitudinally adjacent cladding panel members of the cladding apparatus according to the present invention.

FIGS. 13 through 18 illustrate other applications of the present invention, where the cladding apparatus is used to cover a portion of a wall of a building structure. In FIGS. 14 through 16, a cladding apparatus 120 is secured to a building 115 for purposes of displaying a message or for providing a decorative accent panel, for example. A pair of longitudinally-extending frame members 140 are spaced apart and secured to the building structure 115, using virtually any of a number of suitable attachment means known to those skilled in the art, such as the lag screws 150 shown in FIG. 15.

The frame members 140 preferably include stop flange portions 148, which correspond generally to the stop flanges 48 described above, and a generally non-flat flange portion 144 having an angled discontinuity 146 thereon, which similarly corresponds generally to the non-flat flange portions 44 and the angled discontinuities 46 described above in connection with the corner frame members 40.

A number of cross members 160 are spaced longitudinally from one another and laterally interconnect the frame members 140 in a manner similar to the interconnection of the cross members 60 and 62 with the corner frame members 40 described above. One or more cladding panel members 122A are attached to, and interconnect the frame members 140 in order to complete the assembly.

The cladding panel members 122A shown in FIGS. 14 through 16 correspond generally in configuration and function with the cladding panel members 22A described above. Each of the cladding panel members 122A includes an angled edge portion 126A and an angled edge portion flange 128A, which correspond respectively to the angled edge portions 26 and the angled edge portion flanges 28 described above. Thus, as was described above in connection with FIGS. 1 through 13, the angled edge portions 126A and the angled edge portion flanges 128A resiliently snap onto, and clampingly engage the non-flat flange portion 144 and the angled discontinuity 146 of the frame members 140.

In order to accomodate a neat and well aligned joint between adjacent cladding panel members 122A whenever the cladding must be applied in more than one piece, a splice block 129, shown in FIG. 16, is inserted into the ends of adjacent cladding panel members 122A.

Figure 17:
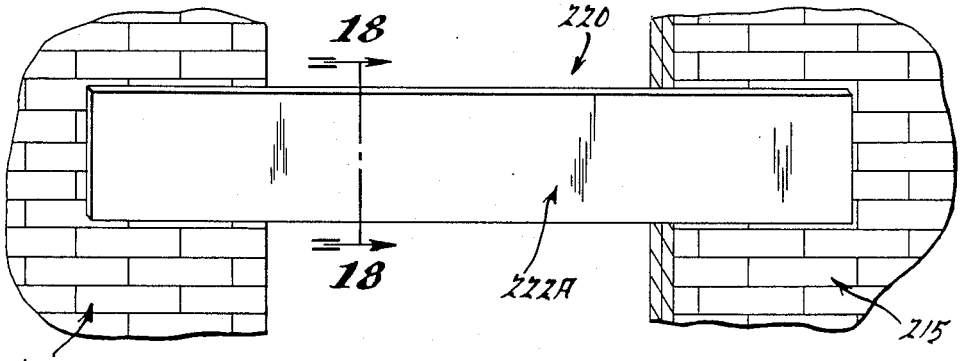
FIG. 17 is a view similar to that of FIG. 14, but illustrating the application of the cladding apparatus of the present invention in an installation where a portion of the cladding apparatus projects outwardly beyond the edge of a building structure and/or bridges the gap between adjacent, spaced-apart building structures.
Figure 18:
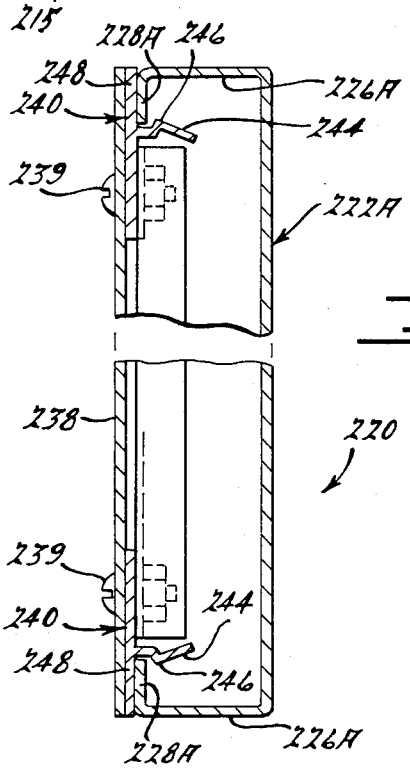
FIG. 18 is a cross-sectional view taken generally along line 18—18 of FIG. 17.

In FIGS. 17 and 18, an exemplary cladding system 220 is shown for use in applications where the cladding apparatus protrudes outwardly beyond the edge of a building structure, or bridges a gap between two adjacent, but spaced-apart, building structures. The various components of the embodiment shown in FIGS. 17 and 18 are substantially similar in configuration and function to those described above in connection with FIGS. 14 through 16. However, because the cladding apparatus 220, and the cladding panel members 222A are visible from their rear or inward side due to the protrusion of the cladding system beyond the edge of the building structure 215, a backing plate or panel 238 is secured to the frame members 240, such as by way of the threaded fasteners 239 shown in FIG. 18, in order to substantially obscure the internal frame work and internal components of the cladding apparatus 220 from view.

From the foregoing description, one skilled in the art will now readily appreciate the various advantages and features used in applying the principles of the present invention to a very wide variety of cladding applications. In this regard, one skilled in the art will also readily recognize that the various components and principles of the present invention described above can be applied in an identical, or at least substantially similar, manner to form the horizontally-extending spandrel assembly 24 shown in FIG. 1.

The foregoing discussion discloses and describes exemplary embodiments of the present invention. One skilled in the art will readily recognize from such discussion, and from the accompanying drawings and claims, that various changes, modifications and variations may be made therein without departing from the spirit and scope of the invention as defined in the following claims.

What is claimed is:

1. A cladding apparatus adapted for substantially enclosing a column, pole or other longitudinal structure, said cladding system comprising:

a number of longitudinally-extending corner frame members adapted to be disposed in a spaced-apart relationship relative to the longitudinal structure:

a number of cross members spaced away from the longitudinal structure and extending laterally between and interconnecting adjacent pairs of said corner frame members, said cross members further being longitudinally spaced apart from one another;

a number of pairs of mounting members disposed at a generally aligned longitudinal position relative to said cross members, each pair of said mounting members being secured to first generally opposite lateral sides of the longitudinal structure and laterally interconnecting a pair of said cross members spaced from second generally opposite sides of the longitudinal structure; and a number of cladding panel members laterally interconnecting adjacent pairs of said corner frame members and extending longitudinally in a generally parallel and spaced-apart relationship with the longitudinal structure in order to substantially surround and obscure the longitudinal structure, said corner frame members having at least two corner frame flange portions extending along at least a portion of their lateral sides, said cladding panel members having angled edge portions thereon, said angled edge portions on adjacent cladding panel members being adapted for engagement with said corner frame flange portions on the same corner frame member, said corner frame flange portions on each of said corner frame members protruding laterally outwardly therefrom and are disposed at an angular relationship relative to one another, one of said angled edge portions on a first of said adjacent cladding panel members engaging a first of said angularly disposed corner frame flange portions on one of said corner frame members and one of said angled edge portions on a second of said adjacent cladding panel members engaging a second of said angularly disposed corner frame flange portions on the same one of said corner frame members and substantially covering said one angled edge portion on said first of said adjacent cladding panel members.

2. A cladding apparatus according to claim 1, wherein each pair of said mounting members are interconnected with a pair of clamping members disposed on said second generally opposite sides of the longitudinal structure, said clamping members forcibly urging said pair of said mounting members generally toward one another into a forcible clamping engagement with the longitudinal structure in order to securely interconnect said cross members, said corner frame members and said cladding panel members with the longitudinal structure.

3. A cladding apparatus according to claim 2, wherein each of said mounting members has a number of mounting openings therethrough corresponding at least to the number of said clamping members, said clamping members comprising elongated threaded fasteners receivable in said mounting openings in said mounting members in order to threadably interconnect said pair of said mounting members and clampingly urging said pair of said mounting members toward one another into said clamping engagement with the longitudinal structure.

4. A cladding apparatus according to claim 3, wherein each of said mounting members has a plurality of said mounting openings therethrough laterally spaced apart from one another in order to allow one or more of said elongated threaded fasteners to be selectively positioned in any of said plurality of mounting openings in order to preselectively alter the lateral position of said clamping members, and thus said mounting members, said cross members, said corner frame members and said cladding panels relative to the longitudinal structure.

5. A cladding apparatus according to claim 1, wherein each of said cross members includes a laterally outwardly-facing cross member flange portion thereon adapted for lateral supporting engagement with an adjacent one of said cladding panel members.

6. A cladding apparatus according to claim 5, wherein at least one of said cross member flange portions has an adhesive material thereon for adhesively engaging said adjacent cladding panel member.

7. A cladding apparatus according to claim 1, further including adjustment means for preselectively altering the lateral angular relationship of said mounting members with the longitudinal structure in order to preselectively alter the lateral angular relationship of said cross member, said corner frame members and said cladding panels with the longitudinal structure.

8. A cladding apparatus adapted for substantially enclosing a column, pole or other longitudinal structure, said cladding system comprising:

a number of longitudinally-extending corner frame members adapted to be disposed in a spaced-apart relationship relative to the longitudinal structure;

a number of cross members spaced away from the longitudinal structure and extending laterally between and interconnecting adjacent pairs of said corner frame members, said cross members further being longitudinally spaced apart from one another;

a number of pairs of mounting members disposed at a generally aligned longitudinal position relative to said cross members, each pair of said mounting members being secured to first generally opposite lateral sides of the longitudinal structure and laterally interconnecting a pair of said cross members spaced from second generally opposite sides of the longitudinal structure; and a number of cladding panel members laterally interconnecting adjacent pairs of said corner frame members and extending longitudinally in a generally parallel and spaced-apart relationship with the longitudinal structure in order to substantially surround and obscure the longitudinal structure, said corner frame members having at least two corner frame flange portions extending along at least a portion of their lateral sides, said cladding panel members having angled edge portions thereon, said angled edge portions on adjacent cladding panel members being adapted for engagement with said corner frame flange portions on the same corner frame member, a first of said corner frame flange portions on each of said corner frame members being generally flat, and wherein a second of said corner frame flange portions on each of said corner frame members including a generally angled non-flat lateral discontinuity extending generally longitudinally therealong.

9. A cladding apparatus according to claim 8, wherein a pportion of each of said non-flat lateral discontinuity is in a non-parallel relationship relative to said flat first corner frame portion and extends in a laterally outwardly diverging direction relative to said flat first corner frame portion in order to facilitate selective removal of said angled edge portions of said cladding panel members from said engagement with said non-flat lateral discontinuity.

10. A cladding apparatus according to claim 9, wherein said angled edge portion on at least said second of said adjacent cladding panel members is resiliently deflectable in order to allow said second of said adjacent cladding panel members to be resiliently snapped onto an adjacent pair of said corner frame members without the use of fasteners, said resiliently deflectable angled edge portions resiliently and clampingly engaging said non-flat discontinuities on a laterally adjacent pair of said corner frame members.

11. A cladding apparatus adapted for substantially enclosing a column, pole or other longitudinal structure, said cladding system comprising:

a number of longitudinally-extending corner frame members adapted to be disposed in a spaced-apart relationship relative to the longitudinal structure;

a number of cross members spaced away from the longitudinal structure and extending laterally between and interconnecting adjacent pairs of said corner frame members, said cross members further being longitudinally spaced apart from one another;

a number of pairs of mounting members disposed at a generally aligned longitudinal position relative to said cross members, each pair of said mounting members being secured to first generally opposite lateral sides of the longitudinal structure and laterally interconnecting a pair of said cross members spaced from second generally opposite sides of the longitudinal structure;

a number of cladding panel members laterally interconnecting adjacent pairs of said corner frame members and extending longitudinally in a generally parallel and spaced-apart relationship with the longitudinal structure in order to substantially surround and obscure the longitudinal structure; and adjustment means for preselectively altering the lateral position at which said mounting members are secured to said cross members in order to preselectively alter the lateral position in a first lateral direction of said cross members, said corner frame members and said cladding panels relative to the longitudinal structure.

12. A cladding apparatus according to claim 11, further including second adjustment means for preselectively altering the lateral position at which said mounting members are secured to the longitudinal structure in order to preselectively alter the lateral position in a second lateral direction of said cross members, said corner frame members and said cladding panels relative to the longitudinal structure.

13. A cladding apparatus adapted for substantially enclosing a column, pole or other longitudinal structure, said cladding system comprising:

a number of longitudinally-extending corner frame members adapted to be disposed in a spaced-apart relationship relative to the longitudinal structure, each of said corner frame members having at least two corner frame flange portions extending along at least a portion of their lateral sides, said corner frame flange portions on each corner frame member protruding laterally outwardly at an angular relationship with one another, a first of said corner frame flange portions being generally flat, and a second of said corner frame flagne portions having a generally angled non-flat discontinuity extending generally longitudinally therealong;

a number of cross members spaced away from the longitudinal structure and extending laterally between and interconnecting adjacent pairs of said corner frame members, said cross members further being longitudinally spaced apart from one another and having cross member flange portions thereon facing generally laterally outwardly;

a number of pairs of mounting members disposed at or generally aligned longitudinal position relative to said cross members, each pair of said mounting members being secured to first generally opposite lateral sides of the longitudinal structure and laterally interconnecting a pair of said cross members spaced from second generally opposite sides of the longitudinal structure, each pair of said mounting members further being interconnected with a pair of clamping members disposed on said second generally opposite sides of the longitudinal structure, said clamping members forcibly urging said pair of said mounting members generally toward one another into a forcible clamping engagement with the longitudinal structure in order to securely interconnect said cross members and said corner frame members with the longitudinal structure; and a number of cladding panel members laterally interconnecting adjacent pairs of said corner frame members and extending longitudinally in a generally parallel and spaced apart relationship with the longitudinal structure in order to substantially surround and obscure the longitudinal structure, said cladding panel members having angled edge portions thereon, said angled edge portions on adjacent cladding panel members engaging said corner frame flange portions on the same one of said corner flame members, one of said angled edge portions on a first of said adjacent cladding panel members engaging said first flat corner frame flange portion on said same one of said corner frame members, and one of said angled edge portions on a second of said adjacent cladding panel members being resiliently deflectable for a resilient snap-on engagement with said second non-flat corner frame flange portion on said same one of said corner frame members, said one angled edge portion on said second of said adjacent cladding panel members substantially covering said one angled portion on said first of said adjacent cladding panel members.

14. A cladding apparatus according to claim 13, wherein a portion of each of said non-flat lateral discontinuity is in a non-parallel relationship relative to said flat first corner frame portion and extends in a laterally outwardly diverging direction relative to said flat first corner frame portion in order to facilitate selective removal of said angled edge portions of said cladding panel members from said engagement with said non-flat lateral discontinuity.

15. A cladding apparatus according to claim 13, wherein each of said mounting members has a number of mounting openings therethrough corresponding at least to the number of said clamping members, said clamping members comprising elongated threaded fasteners receivable in said mounting openings in said mounting members in order to threadably interconnect said pair of said mounting members and clampingly urging said pair of said mounting members toward one another into said clamping engagement with the longitudinal structure.

16. A cladding apparatus according to claim 15, wherein each of said mounting members has a plurality of said mounting openings therethrough laterally spaced apart from one another in order to allow one or more of said elongated threaded fasteners to be selectively positioned in any of said plurality of mounting openings in order to preselectively alter the lateral position of said clamping members, and thus said mounting members, said cross members, said corner frame members and said cladding panels relative to the longitudinal structure.

17. A cladding apparatus according to claim 13, wherein at least one of said cross member flange portions has an adhesive material thereon for adhesively engaging said adjacent cladding panel member.

18. A cladding apparatus according to claim 13, further including adjustment means for preseletively altering the lateral position at which said mounting members are secured to said cross members in order to preselectively alter the lateral position in a first lateral direction of said cross members, said corner frame members and said cladding panels relative to the longitudinal structure.

19. A cladding apparatus according to claim 18, further including second adjustment means for preselectively altering the lateral position at which said mounting members are secured to the longitudinal structure in order to preselectively alter the lateral position in a second lateral direction of said cross members, said corner frame members and said cladding panels relative to the longitudinal structure.

20. A cladding apparatus according to claim 13, further including adjustment means for preselectively altering the lateral angular relationship of said mounting members with the longitudinal structure in order to preselectively alter the lateral angular relationship of said cross members, said corner frame members and said cladding panels with the longitudinal structure.

* * * * *

UNITED STATES PATENT AND TRADEMARK OFFICE

CERTIFICATE OF CORRECTION

PATENT NO. : 4,823,533

DATED : April 25, 1989

INVENTOR(S) : David U. Hillstrom

It is certified that error appears in the above-identified patent and that said Letters Patent is hereby corrected as shown below:

| | | |
|---|---|---|
| Column 2, | line 49, | "claim" should be --claims--. |
| Column 2, | line 53, | "prospective" should be --perspective--. |
| Column 2, | line 55, | "of", 1st occurrence, should be --on--. |
| Column 6, | line 66, | "self-taping" should be --self-tapping--. |
| Column 7, | line 67, | "accomodate" should be --accommodate--. |
| Column 10, | line 42, | "pportion" should be --portion--. |
| Column 11, | line 46, | "flagne" should be --flange--. |
| Column 12, | line 15, | "flame" should be --frame--. |
| Column 12, | line 26, | insert "edge" after --angled--. |
| Column 12, | line 65, | "preseletively" should be --preselectively--. |

Signed and Sealed this

Twenty-ninth Day of May, 1990

*Attest:*

HARRY F. MANBECK, JR.

*Attesting Officer*

*Commissioner of Patents and Trademarks*